US010717452B2

(12) United States Patent
Paisley

(10) Patent No.: US 10,717,452 B2
(45) Date of Patent: Jul. 21, 2020

(54) HAND CART FOR CONSTRUCTION IN THE RAILROAD INDUSTRY

(71) Applicant: S & K Steel Products, Inc., Madison Heights, MI (US)

(72) Inventor: Myles E. Paisley, Troy, MI (US)

(73) Assignee: Myles E. Paisley, Troy, MI (US)

( * ) Notice: Subject to any disclaimer, the term of this patent is extended or adjusted under 35 U.S.C. 154(b) by 348 days.

(21) Appl. No.: 15/795,734

(22) Filed: Oct. 27, 2017

(65) Prior Publication Data

US 2018/0118234 A1 May 3, 2018

Related U.S. Application Data

(60) Provisional application No. 62/414,584, filed on Oct. 28, 2016.

(51) Int. Cl.

| | |
|---|---|
| ***B61D 15/10*** | (2006.01) |
| ***B61F 5/28*** | (2006.01) |
| ***B61D 15/00*** | (2006.01) |
| ***B61F 1/14*** | (2006.01) |

(52) U.S. Cl.

CPC ..... *B61D 15/10* (2013.01); *B61D 15/00* (2013.01); *B61F 1/14* (2013.01); *B61F 5/28* (2013.01)

(58) Field of Classification Search

CPC ... B61F 5/26; B61F 5/28; B61D 15/00; B61D 15/08; B61D 15/10; B61D 15/12

USPC ..... 105/162, 178

See application file for complete search history.

(56) References Cited

U.S. PATENT DOCUMENTS

| | | | | | |
|---|---|---|---|---|---|
| 298,736 | A * | 5/1884 | Dunbar et al. | B61D 15/12 | 105/162 |
| 650,195 | A * | 5/1900 | Schaffer | B61D 15/10 | 105/88 |
| 722,078 | A * | 3/1903 | Blomberg | B61D 15/10 | 105/95 |
| 1,018,264 | A * | 2/1912 | Palmer | B61D 15/10 | 105/88 |
| 1,097,104 | A * | 5/1914 | McGlinsey et al. | B61D 15/10 | 105/143 |
| 1,344,947 | A * | 6/1920 | Hastings | B61D 15/10 | 105/164 |
| 1,395,559 | A * | 11/1921 | Davis | B61D 15/10 | 105/142 |
| 1,745,630 | A * | 2/1930 | Mahana | B61D 15/12 | 105/162 |
| 2,004,676 | A * | 6/1935 | Seitter | B61D 15/10 | 105/160.5 |
| 2,775,465 | A | 12/1956 | Swingler | | |
| 2,835,503 | A | 5/1958 | Humphries et al. | | |

(Continued)

FOREIGN PATENT DOCUMENTS

| | | | | |
|---|---|---|---|---|
| CN | 201184080 Y | 1/2009 | | |
| WO | WO-2012156749 A2 * | 11/2012 | ..... | B61D 15/10 |

*Primary Examiner* — Zachary L Kuhfuss

(74) *Attorney, Agent, or Firm* — Fishman Stewart PLLC

(57) ABSTRACT

A handcart for manually conveying objects on a pair of railroad rails includes a first structure having a first end and a second end, the first end having a first opening therein, a second structure attached to the first support bar such that a frame is formed between the first and second structures by one or more crossbeams, and a first wheel assembly having a first wheel and a first axle extending therefrom, the first axle detachably locked via the first axle positioned in the first opening.

18 Claims, 16 Drawing Sheets

(56) References Cited

U.S. PATENT DOCUMENTS

| | | | | |
|---|---|---|---|---|
| 3,149,583 | A | 9/1964 | Morrill | |
| 3,424,106 | A * | 1/1969 | Webb | B61D 15/12 105/26.1 |
| 4,213,397 | A * | 7/1980 | Matte | B60F 1/005 105/95 |
| 4,574,707 | A | 3/1986 | Hickman | |
| 4,789,195 | A | 12/1988 | Fletcher | |
| 5,016,948 | A | 5/1991 | Welch et al. | |
| 5,224,720 | A * | 7/1993 | Chaw | B62B 7/04 280/30 |
| 5,269,545 | A | 12/1993 | Huebschen et al. | |
| 5,622,115 | A | 4/1997 | Ehrlich et al. | |
| 5,642,898 | A | 7/1997 | Wise | |
| 5,975,826 | A | 11/1999 | Scholder | |
| 6,089,163 | A * | 7/2000 | Williams | E01B 35/02 104/2 |
| 6,099,220 | A | 8/2000 | Poth | |
| 6,123,029 | A | 9/2000 | Mobley | |
| 6,155,175 | A | 12/2000 | Rude et al. | |
| 6,443,467 | B1 * | 9/2002 | Black | B62B 7/046 280/47.38 |
| 6,572,123 | B2 | 6/2003 | Calmeise et al. | |
| 6,615,973 | B2 | 9/2003 | Fritter | |
| 6,669,213 | B2 | 12/2003 | Woerner | |
| 6,827,364 | B1 | 12/2004 | Martin | |
| 7,150,465 | B2 | 12/2006 | Darling, III | |
| 7,367,571 | B1 | 5/2008 | Nichols | |
| 7,641,235 | B1 * | 1/2010 | Anduss | B60R 9/06 224/509 |
| 7,740,084 | B2 | 6/2010 | Rosenboom | |
| 7,766,365 | B2 | 8/2010 | Darling, III | |
| 7,789,352 | B2 | 9/2010 | Darling, III | |
| 8,186,250 | B2 | 5/2012 | Ross | |
| 8,505,959 | B2 | 8/2013 | Darling, III | |
| 2002/0043174 | A1 * | 4/2002 | Sheridan | E05D 15/1002 105/396 |
| 2002/0105169 | A1 * | 8/2002 | Dahl | B62B 1/002 280/651 |
| 2006/0021985 | A1 | 2/2006 | Jasper | |
| 2008/0276830 | A1 * | 11/2008 | Dawson | B61D 3/182 105/355 |
| 2010/0024191 | A1 | 2/2010 | Ledbetter | |
| 2018/0118234 | A1 * | 5/2018 | Paisley | B61D 15/10 |

* cited by examiner

HAND CART FOR CONSTRUCTION IN THE RAILROAD INDUSTRY

CROSS-REFERENCE TO RELATED APPLICATIONS

This application claims priority to U.S. Provisional Patent Application Ser. 62/414,584, filed Oct. 28, 2016, the contents of which are hereby incorporated by reference in their entirety.

TECHNICAL FIELD

The disclosure relates to a hand cart for construction and maintenance in the railroad industry. More specifically, the disclosure relates to an improved hand cart that can be disassembled when transporting to and from a job site.

BACKGROUND

In the railroad industry, railroad tracks may be damaged for a variety of reasons, to include wear, weather damage to the tracks (such as washed out sections from weather events), or from vandalism, to name a few. Damage to components related to the railroad industry can occur as well. For instance, road-crossing lights and bell systems, safety control systems for controlling operation of trains operating on the tracks, and railroad ties themselves can be damaged from use, abrasive wear, deterioration, and the like.

In addition to repairing track or other related components, new construction may also occur, such as laying new track or modifying existing track to include new features (such as new safety or warning features).

Thus, there are numerous possible reasons why construction or repair may be occurring along railroad tracks. Often, however, the location for conducting such work is remote and not easily accessible by car or truck. As such, aside from using the tracks themselves, there may not be a convenient or cost-efficient way to bring tools and repair parts to and from the work site where the construction or repair is to occur.

Accordingly, over the years the railroad industry has developed handcars that may be manually operated or pushed to the work site. In the early days of the railroad, typically a large team of railroad workers was available, which could be moved to the site via manually operated carts. One early version of a work cart includes a handcar in which an input shaft was manually operated in a 'see-saw' fashion type, causing power to transfer from an input shaft to a drive wheel via a linkage. Such a design included sufficient space for two or more people to provide power to the input shaft, and included sufficient space on a platform to carry passengers and equipment. Thus, a team of workers and their equipment could be readily and inexpensively conveyed to a work site if no other means of transport were available.

Over the years, with improved repair and construction tooling, and with increased cost of labor, the size of handcars for construction and repair of railroads decreased in size. Typically, a team of laborers placed a handcart on the tracks, loaded the handcart with tooling, and manually pushed the handcart to the work site. In some instances, it may be necessary to allow for passage of a train, thus the cart may need to be removed from the tracks at the job site during a construction or repair job.

With continued efficiencies and increases in the cost of labor, work crews have continued to diminish in size and todays work crew typically includes perhaps one worker and one helper. As such, todays handcart is sufficiently small that it can be loaded and pushed to the job site by just one or two workers. Typically, the handcarts of today may weigh in excess of 100 pounds (45 kg), while having limited capacity of perhaps 1000 pounds (450 kg). Such handcarts can be awkward to transport from a truck to the tracks, and may even require two or more workers to safely or properly transport the handcart to the tracks. Once positioned on the tracks, the one or two workers may load the handcart with tools and manually push the handcart along the tracks to the job site. Further, over time the amount of equipment necessary at the work site has tended to increase, as construction and repair equipment has gotten more sophisticated. Thus, as work crews have generally reduced in size to perhaps one or two workers, the amount of equipment at the site has increased in some regards.

However, 100 pounds may be excessive for one or even two workers to safely transport from the truck to the tracks. Thus, it is impractical to simply use larger and heavier handcarts to convey such equipment. In fact, some workers may be limited for health or medical reasons to carrying only a certain amount of weight to avoid overexertion and injury from occurring. In addition, safety standards such as the Occupational Safety and Health Administration (OSHA) may limit the amount of material that may be carried by one worker. Thus, if the number of workers to carry the handcart is insufficient, the worker may be inconvenienced or even prevented from being able to carry out the required construction or repair task.

In addition, existing handcarts may include a flat or planar surface on which tools and equipment are placed during conveyance of the handcart. However, due to the motion and vibration that can occur during movement of the handcart on railroad tracks, the tools and equipment are prone to rolling and falling off of the platform.

Further, handcarts typically include wheels that include flanges that maintain the wheels, and therefore the cart, on the rails. However, due to dynamic motion of the handcart, shifting loads on the handcart, and the like, handcarts have a propensity to derail during use.

As such, there is a need to conveniently reduce the amount of mass of a handcart in the railroad construction industry while increasing the capacity of the handcart. There is also a need to improve the ability for the handcart to convey tools and equipment without parts rolling or vibrating off of the cart, and without the cart derailing during use.

SUMMARY

The present disclosure described herein is related to a handcart for manually conveying objects on a pair of railroad rails. The disclosed system in one example includes a first structure having a first end and a second end, the first end having a first opening therein, a second structure attached to the first support bar such that a frame is formed between the first and second structures by one or more crossbeams, and a first wheel assembly having a first wheel and a first axle extending therefrom, the first axle detachably locked via the first axle positioned in the first opening.

The present disclosure also includes a method of fabricating a handcart for manually conveying objects on a pair of railroad rails. The disclosed method includes providing a first structure having a first end and a second end, the first end having a first opening therein, attaching a second structure to the first support bar such that a frame is formed between the first and second structures by one or more crossbeams, providing a first wheel assembly having a first wheel and a first axle extending therefrom, and detachably locking the first axle in the first opening.

The present disclosure also includes a method of modifying a handcart for conveying objects on a pair of railroad rails. The method includes providing a handcart that includes at least one wheel having a welded axle that is welded to a frame of the handcart, cutting the welded axle to remove the at least one wheel from the handcart, and welding a wheel assembly to the handcart at a location proximate where the welded axle was cut. The wheel assembly includes a structure having an opening therein, the wheel assembly having a first wheel having a first axle extending therefrom and detachably locked to the structure via the first axle within the opening.

DETAILED DESCRIPTION

The present disclosure described herein is related to a handcart for manually conveying objects on a pair of railroad rails. The disclosed system in one example includes a first support bar having a first end and a second end, the first end having a first opening therein. The handcart includes a second support bar attached to the first support bar such that a frame is formed between the first and second support bars, a platform positioned on the frame, and a wheel assemblies each having a wheel and an axle extending therefrom, the axle detachably locked via the axle positioned in the first opening.

As such, with wheel assemblies detachable from the frame, according to the disclosure, the maximum weight that may be necessary for any individual or worker to carry at any given time is reduced when needed. That is, the ability to disassemble and reassemble the disclosed handcart provides a convenient and practical solution in which wheel assemblies may be individually carried, or carried a few at a time, separate from other components of the handcart itself. Accordingly, rather than having to carry an entire handcart assembly from for instance a truck to a set of railroad tracks, the disclosed subject matter provides a convenient apparatus, and includes a method for modifying existing handcart devices that have their wheels hard-mounted to the handcart, such that wheels can be conveniently removed. As such and in general, wheel assemblies detachably or removably locked to a frame, according to the disclosure, have insertion pins or other mechanisms that may be non-destructively removed, such that the wheel assembly may be removed without damage to any of the components. Such is in contrast to welded or brazed structures that are not detachably or removably locked, but instead must be destructively removed by cutting or other destructive methods.

Figure 1:
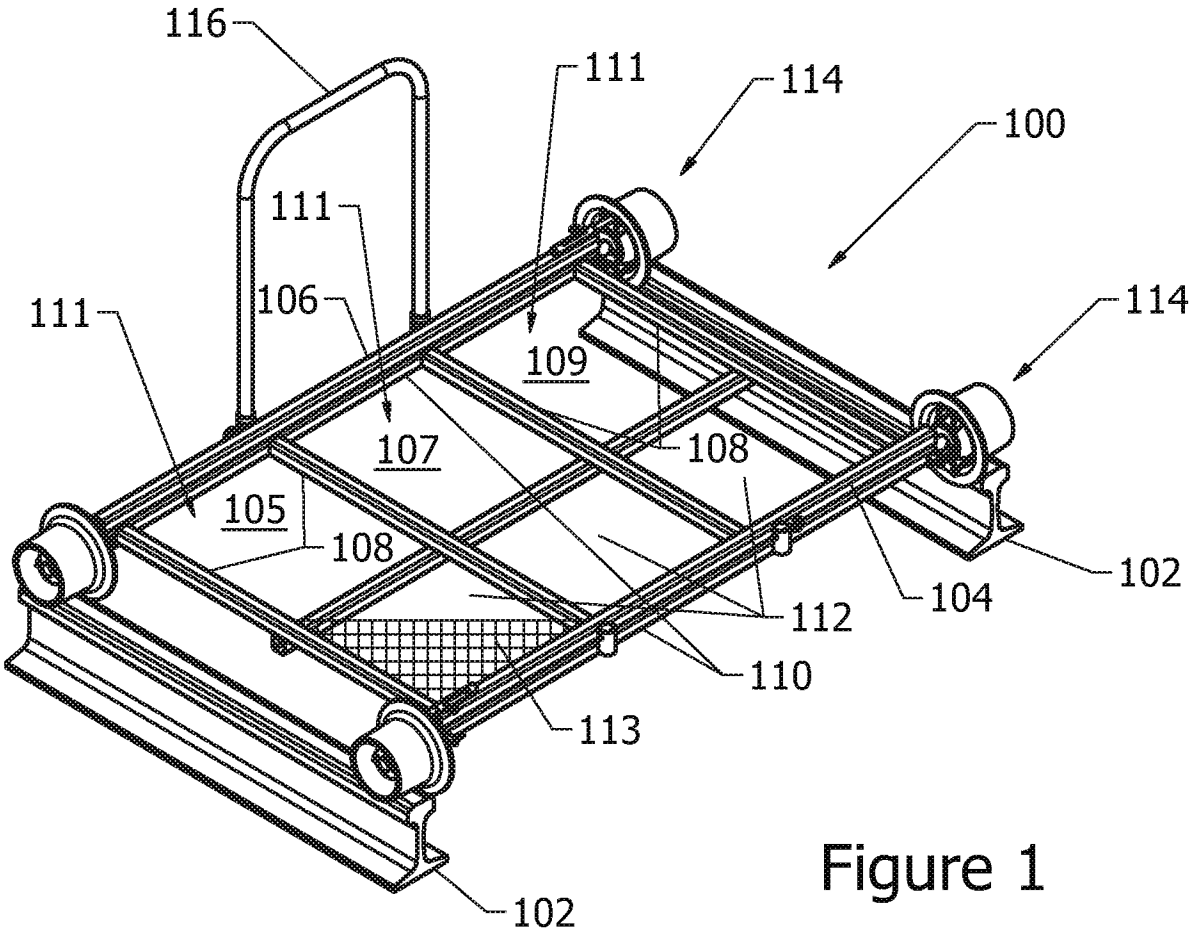
FIG. 1 illustrates a perspective view of an example of the disclosed handcart positioned on a pair of railroad tracks.

That is, in one example a disclosed handcart may include removable wheels. In another example, existing handcarts may be modified to have removable wheels placed thereon. The disclosed examples allow sub-components (i.e., wheels and the body of the handcart assembly) to be carried separately from, for instance, a truck, and quickly assembled after moving the parts to the railroad tracks. Once assembled at the tracks, the handcart can be loaded with tools and other materials to be used at a worksite, and conveniently wheeled to the worksite. As will be further discussed, the disclosed apparatus includes a platform having troughs or depressions that prevent tools or other equipment from rolling or vibrating off of the handcart, FIG. 1 illustrates a perspective view of an example of the disclosed handcart positioned on a pair of railroad tracks. Referring to FIG. 1, a handcart assembly 100 is positioned on railroad tracks 102. Handcart assembly 100 includes a first support bar 104 and a second support bar 106. In one example handcart assembly 100 includes support crossbeams 108 that mechanically connect first support bar 104 with second support bar 106 to form a frame 110. First and second support bars 104, 106, as well as crossbeams 108 may be fabricated of any metal structural material that may be used to mechanically attach together and form frame 110. In one example, first and second support bars 104, 106, as well as crossbeams 108, are double box beams that provide structural rigidity to handcart assembly 100. It is contemplated that other designs may be applicable as well, such as I-beams, circular bars, and the like. Further, and as illustrated according to one example, additional support bars may be included, such as the exemplary support bar that is positioned generally parallel to each of first and second support bars 104, 106.

Handcart assembly 100 includes a platform 112 that is positioned as a generally flat or planar material, or as a grated mesh material, and attached to bottom surfaces of first and second support bars 104, 106, as well as bottom surfaces of crossbeams 108. It is contemplated, in one example, that platform 112 extends over a top of the entire frame 110, such that tools and other items may be placed thereon and transported via handcart assembly 100. In the illustrated example, platform 112 is a planar material 113 shown only over a portion of platform 112. However, it is understood that planar material 113 spans over an entire area between first and second support bars 104, 106, and to the outermost crossbeams 108.

In another example, it is contemplated that platform 112 is comprised of separate planar materials, such as planar material 113, in locations 105, 107, 109 that are each separately attached to bottom surfaces of first and second support bars 104, 106, as well as bottom surfaces of crossbeams 108. In another example, it is contemplated that planar material 113 is attached to an upper surface of support structures that are beneath support bars 104, 106. Regardless of whether platform 112 is comprised of a single material or of several materials 105, 107, 109, it is further contemplated in this example that trough or depression areas 111 are formed that are delineated or bounded by first and second support bars 104, 106, and crossbeams 108. In such fashion, troughs or depression areas 111 form spaces or regions where items such as tools or other hardware may be placed, and lips formed by each of first and second support bars 104, 106, and crossbeams 108 prevent such tools or materials from rolling or otherwise vibrating off of platform 112. That is, trough or depression areas 111 are formed having planar material 113 positioned on the bottom of frame 110, beneath corresponding support structures beneath support bars 104, 106, having depths that prevent items from rolling off of platform 112 during movement of handcart assembly 100 on railroad tracks 102. Handcart assembly 100 includes wheel assemblies 114 that are attached to first and second support bars 104, 106. Handcart assembly 100 includes a mounted structure 116 that is attached to second support bar 106. Mounted structure 116 provides a convenient handle for workers to press upon or pull, to move handcart assembly 100 when loaded with tools or other hardware.

Figure 2:
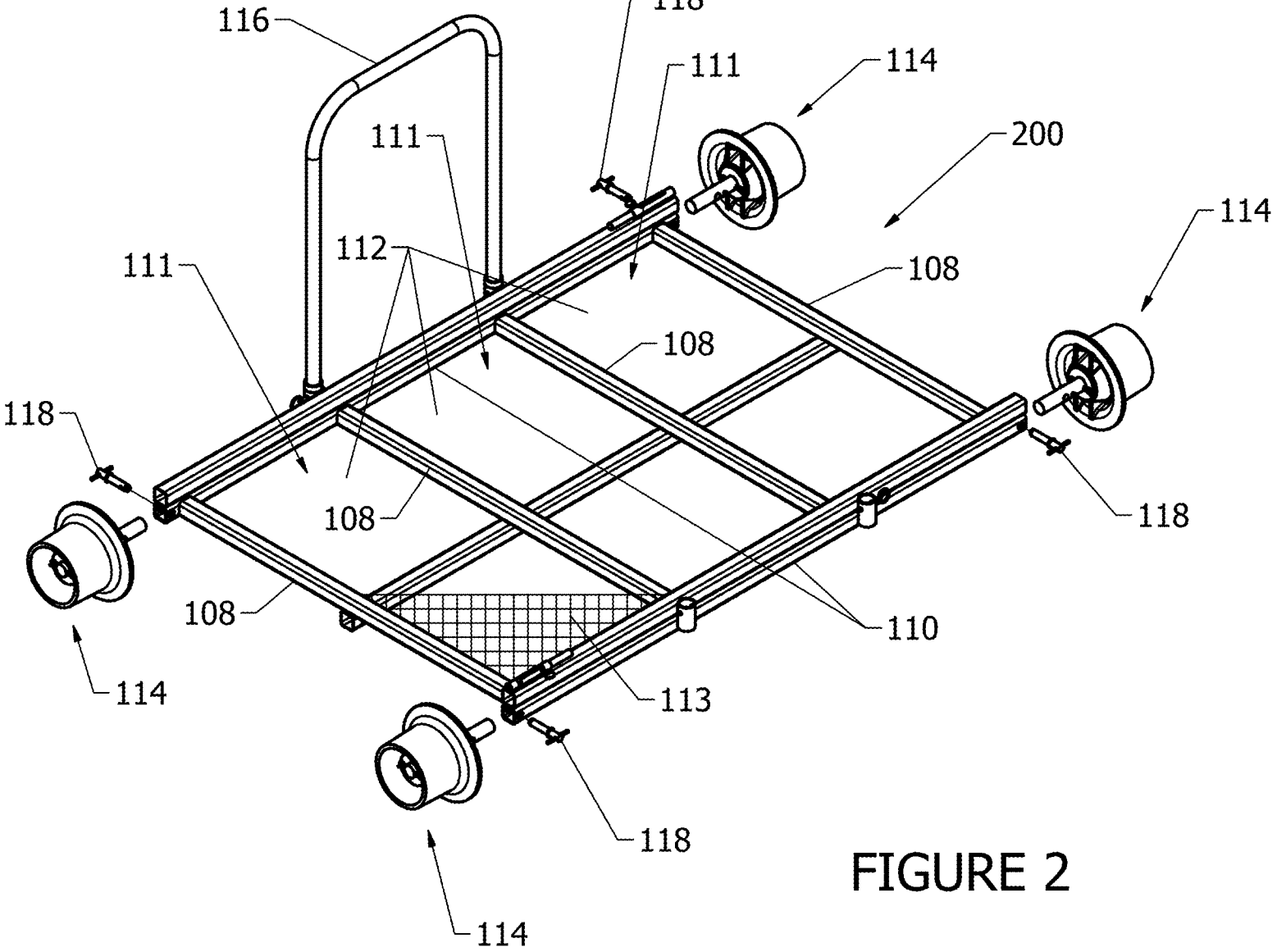
FIG. 2 illustrates a perspective view of the handcart of FIG. 1, illustrating wheel assemblies and pins proximate thereto and in exploded view according to one example of the disclosure.

FIG. 2 illustrates a perspective view of the handcart of FIG. 1, illustrating wheel assemblies and pins proximate thereto and in exploded view 200 according to one example of the disclosure. Exploded view 200 includes frame 110, platform 112, depressions 111, wheel assemblies 114, and mounted structure 116 as described with respect to FIG. 1. Wheel assemblies 114 are illustrated as having been removed from frame 110. Exploded view 200 illustrates pins 118 having also been removed from handcart assembly 100. In the illustrated example, platform 112 is shown spanning between each of crossbeams 108 and attached to a bottom surface thereof, forming depression areas 111 as discussed. However, in an alternative example, a planar material 113 is positioned on a top surface of each of crossbeams 108.

Figure 3:
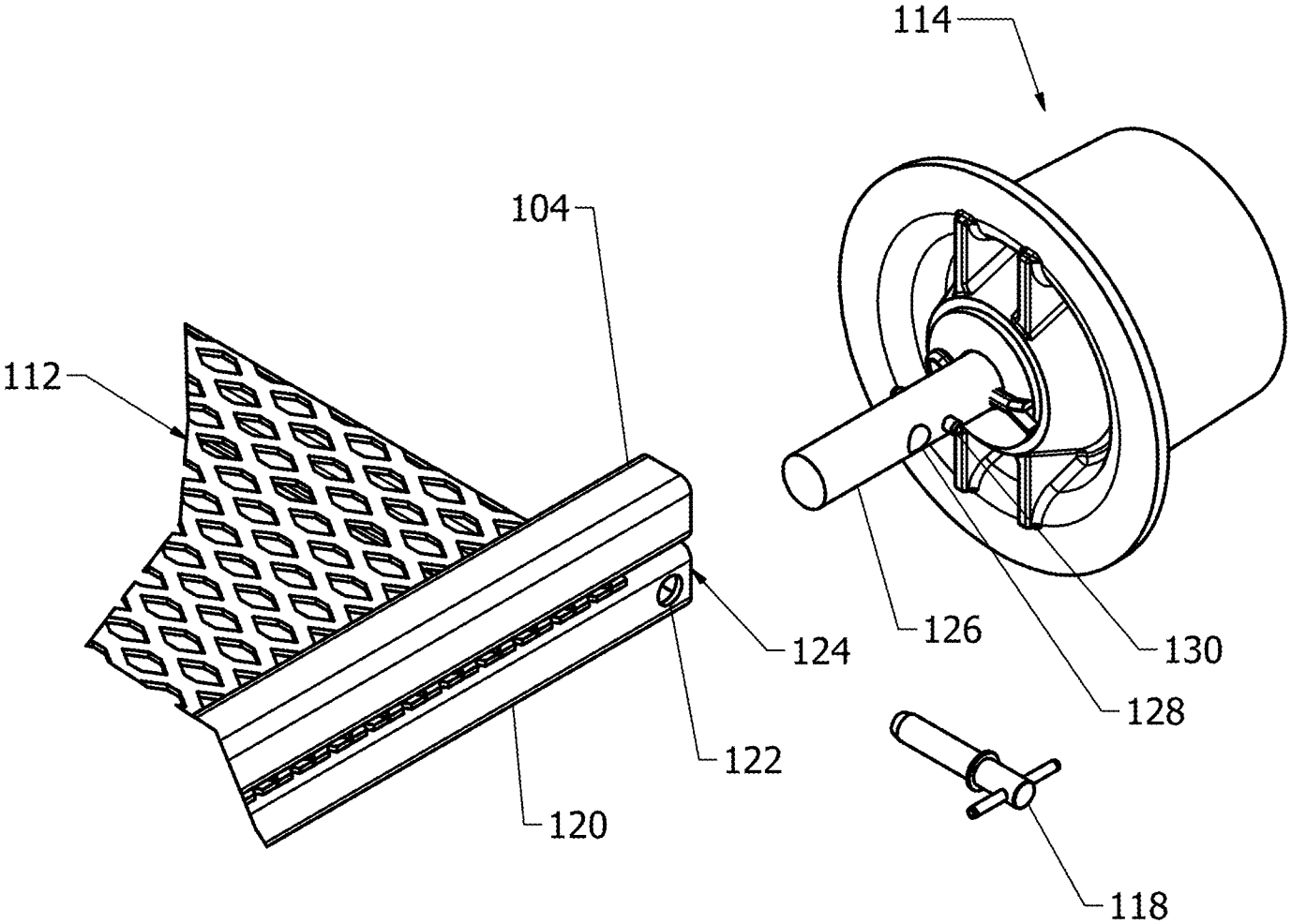
FIG. 3 illustrates a close-up view of an exemplary wheel assembly and pin of FIGS. 1 and 2.

FIG. 3 illustrates a close-up view of an exemplary wheel assembly and pin of FIGS. 1 and 2. As shown therein, first support bar 104 includes platform 112 illustrated thereon in part. Below and attached to first support bar 104 is a structure 120 that includes a hole 122 passing therethrough. In one example, structure 120 is shaped as a box-beam having an opening 124 therein. Thus, hole 122 in structure 120 passes through a second hole (not visible) in structure 120 that forms the box-beam. Opening 124 is appropriately sized so that an axle 126 of wheel assembly 114 passes thereto. Axle 126 includes a through hole 128 as well, and in one example a pin or stopper element 130 is attached thereto. Pin or stopper element 130 is positioned such that, when axle 126 is passed into and positioned within opening 124 of structure 120, pin or stopper element 130 engages against structure 120 in such a position so that through hole 128 is aligned with hole 122 in structure 120. Thus, when through hole 128 is aligned with hole 122, pin 118 may be passed through, causing axle 126 of wheel assembly 114 to detachably lock thereto.

Figure 4:
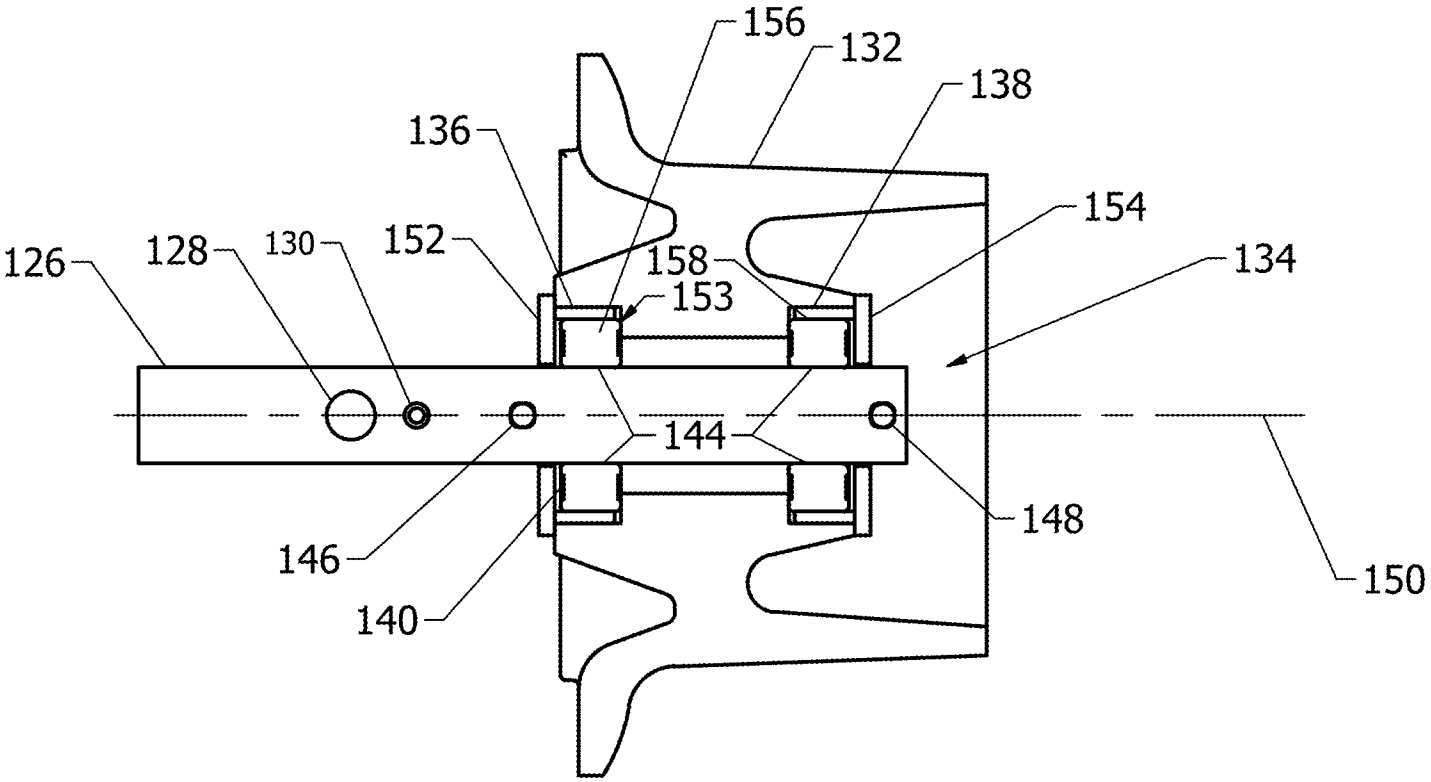
FIG. 4 illustrates a cross-sectional view of the exemplary wheel assembly of FIG. 3.

FIG. 4 illustrates a cross-sectional view of the exemplary wheel assembly 114 of FIG. 3. Wheel assembly 114 includes axle 126 having through hole 128 and pin or stopper element 130. Wheel assembly 114 includes a wheel 132 having an opening 134 therein. Opening 134 passes through wheel 132, and includes a first bore 136 and a second bore 138. A first bearing assembly 140 is positioned within first bore 136, and a second bearing assembly 142 is positioned within second bore 138. As known in the art, bearing assemblies 140, 142 include inner raceways, outer raceways, and bearing balls that extend about a circumference thereof. The inner raceways each include an inner bore 144 that correspond approximately with an outer diameter of axle 126. Axle 126 includes a first cotter key hole 146 and a second cotter key hole 148. Axle 126 may be inserted within inner bore 144 of each of bearing assemblies 140, 142, and a cotter key (not shown) may be positioned within each or cotter key holes 146, 148. Thus, wheel 132 may therefore be caused to rotate with respect to a central rotational axis 150 of axle 126, and about axle 126. The cotter keys thereby detachably and axially lock wheel 132 with respect to axle 126. And, referring back to FIGS. 1-3, wheel(s) 132 may thereby be detachably locked to frame 110 via axle 126 and pin 118.

Referring again to FIG. 4, in one example wheel assembly 114 includes electrically insulating materials to electrically insulate wheel 132 from axle 126. As known in the industry, railroad tracks, such as tracks 102 shown in FIG. 1, may include electrical signals passing therethrough. In such fashion, various communication devices (such as for safety or other communication tasks) employ electrical signals to pass through tracks 102. Some devices operate safety mechanisms when, for instance, an electrical short is formed between rails 102. Thus, if handcart assembly 100 were to pass on tracks 102 and provide an electrical short therebetween, a safety or other mechanism may be triggered and provide a 'false positive' of a train on the tracks.

As such, in one example, wheel assembly 114 includes electrically insulating axially outer washer-shaped materials 152, 154, with one of washer-shaped material 152 positioned proximate bearing assembly 140, and the other washer-shaped material 154 positioned proximate bearing assembly 142. Wheel assembly 114 also includes axially inner washer-shaped materials 153, 155, with one of washer-shaped material 153 positioned proximate bearing assembly 140, and the other washer-shaped material 155 positioned proximate bearing assembly 142. As such, electrically insulating washer-shaped materials 152, 153, 154, and 155 electrically insulate wheel 132 in an axial direction. Wheel assembly 140 may also include cylindrical-shaped electrically insulating materials 156, 158 that electrically insulate bearings 140, 142 from wheel 132. Electrically insulating washer-shaped materials 152, 154, and cylindrical-shaped electrically insulating materials 156, 158, thereby electrically insulate axle 126 from wheel 132. Accordingly, when handcart assembly 100 is positioned on tracks 102, an electrical short does not occur between tracks 102.

Figure 5:
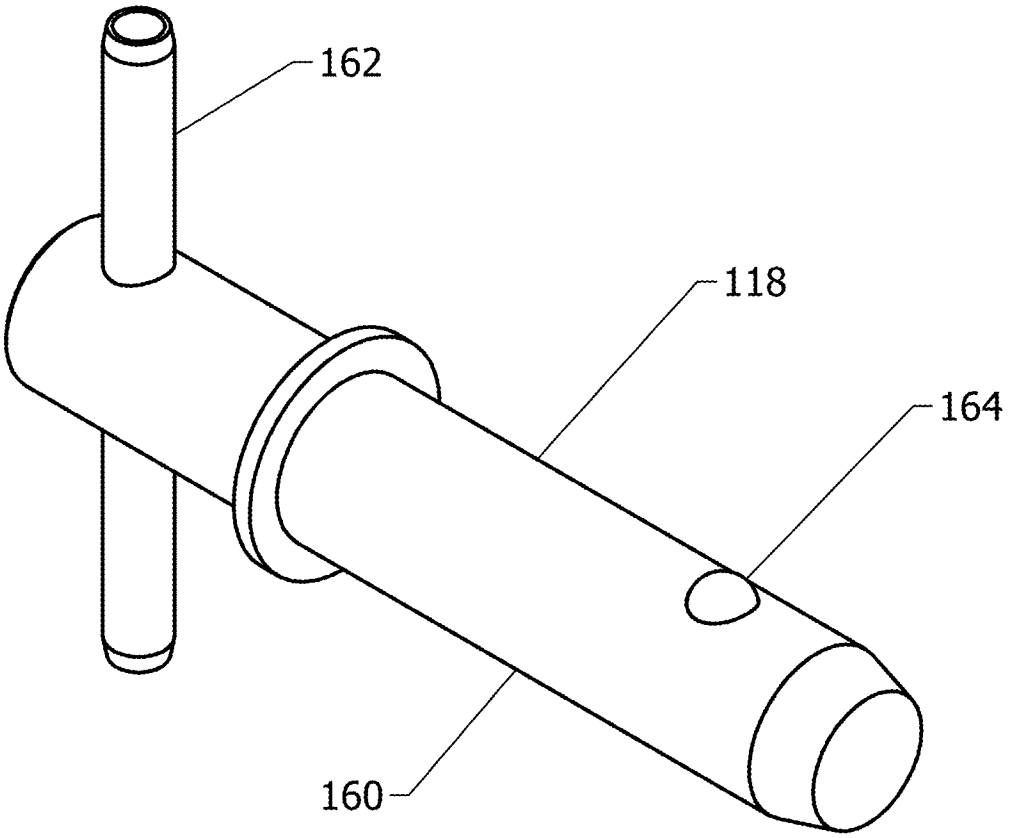
FIG. 5 illustrates an exemplary pin as shown in FIG. 3.

FIG. 5 illustrates an exemplary pin 118 as shown in FIG. 3. In the illustrated example, pin 118 includes a shaft 160 and a handle 162. A detent 164 is included that provides a slight interference for when shaft 160 of pin 118 is positioned within holes 122 and 128. Detent 164 in one example is a hard mechanical nub or bump that is appropriately designed to pass through holes 122 and 128 with some minor degree of interference, a few thousandths of an inch in this example. In another example, detent 164 is a spring-loaded nub or bump that retracts against a spring within shaft 160 during its insertion into holes 122 and 128. As such, once inserted, detent 164 provides a degree of interference to prevent pin from falling out of holes 122 and 128 during use.

Figure 6:
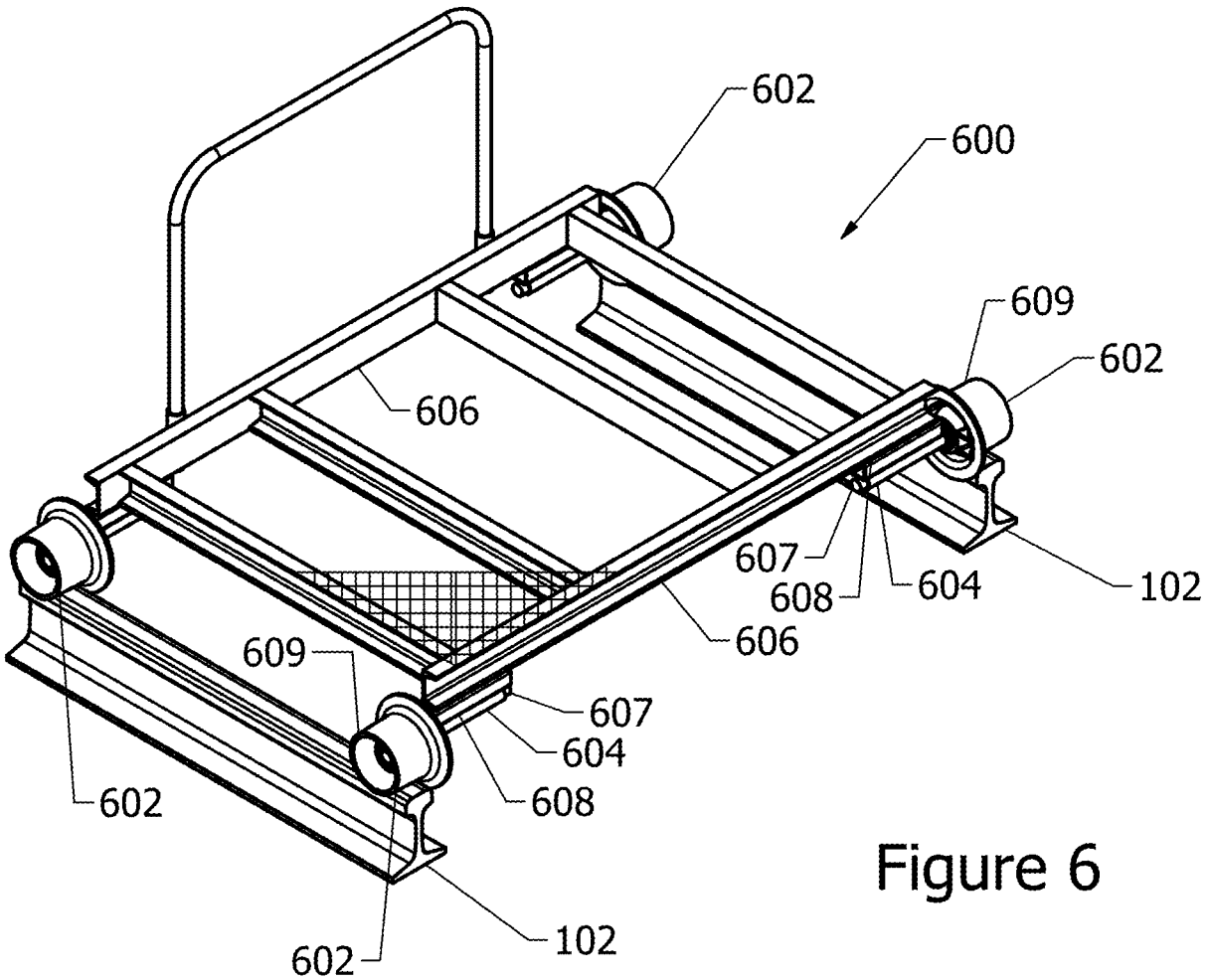
FIG. 6 illustrates a perspective view of a typical existing handcart positioned on a pair of railroad tracks, the typical existing handcart may be modified according to the disclosure.

FIG. 6 illustrates a perspective view of an exemplary existing handcart positioned on a pair of railroad tracks, in which its wheels and wheel assemblies are hard-mounted to the handcart via, for instance, a weld, braze, or other methods of attachment. The existing handcart may be modified according to the disclosure. As shown therein, FIG. 6 illustrates an exemplary existing handcart 600 positioned on railroad tracks, such as railroad tracks 102 of FIG. 1. In the illustrated example, existing handcart 600 includes wheel assemblies 602 that are hard-mounted to handcart 600, and not readily removable therefrom. In one example, existing handcart 600 typically includes a mounting bracket 604 that includes an axle 607 therein, and a wheel 609 that is rotatably connected to axle 607. Mounting bracket 604 may itself be directly connected, for instance via a weld or braze, to cross-bracket(s) 606. In another example, mounting bracket 604 may include an intermediate mounting bracket 608 that is welded or otherwise attached to both the mounting bracket 604 and the cross-bracket 606.

The existing exemplary existing handcart 600 of FIG. 6 may be modified to have removable wheels, according to the disclosure. In one example, referring to FIG. 7A, existing handcart 600 is positioned such that its hard-mounted wheels may be destructively removed from existing handcart 600, as in FIG. 7B. That is, existing handcart 600 in the example of FIG. 7B has its wheel assemblies 602 removed by cutting axles of each of wheel assemblies 602, while a replacement assembly 610 is prepared for replacement of wheels 602. Replacement assembly or assemblies 610 each include, as in the exemplary FIG. 7A, a mounting bracket 612, a wheel assembly 614, and a pin 616. In similar fashion to that described above regarding wheel assembly 114 and structure 120, mounting bracket 612 may be attached to existing handcart 600 at each location of wheel assemblies 602, and new and detachable wheel assemblies 614 may thereby be detachably positioned on existing handcart 600. Pins 616 may thereby provide the detachably removable device for doing so.

Figure 7A:
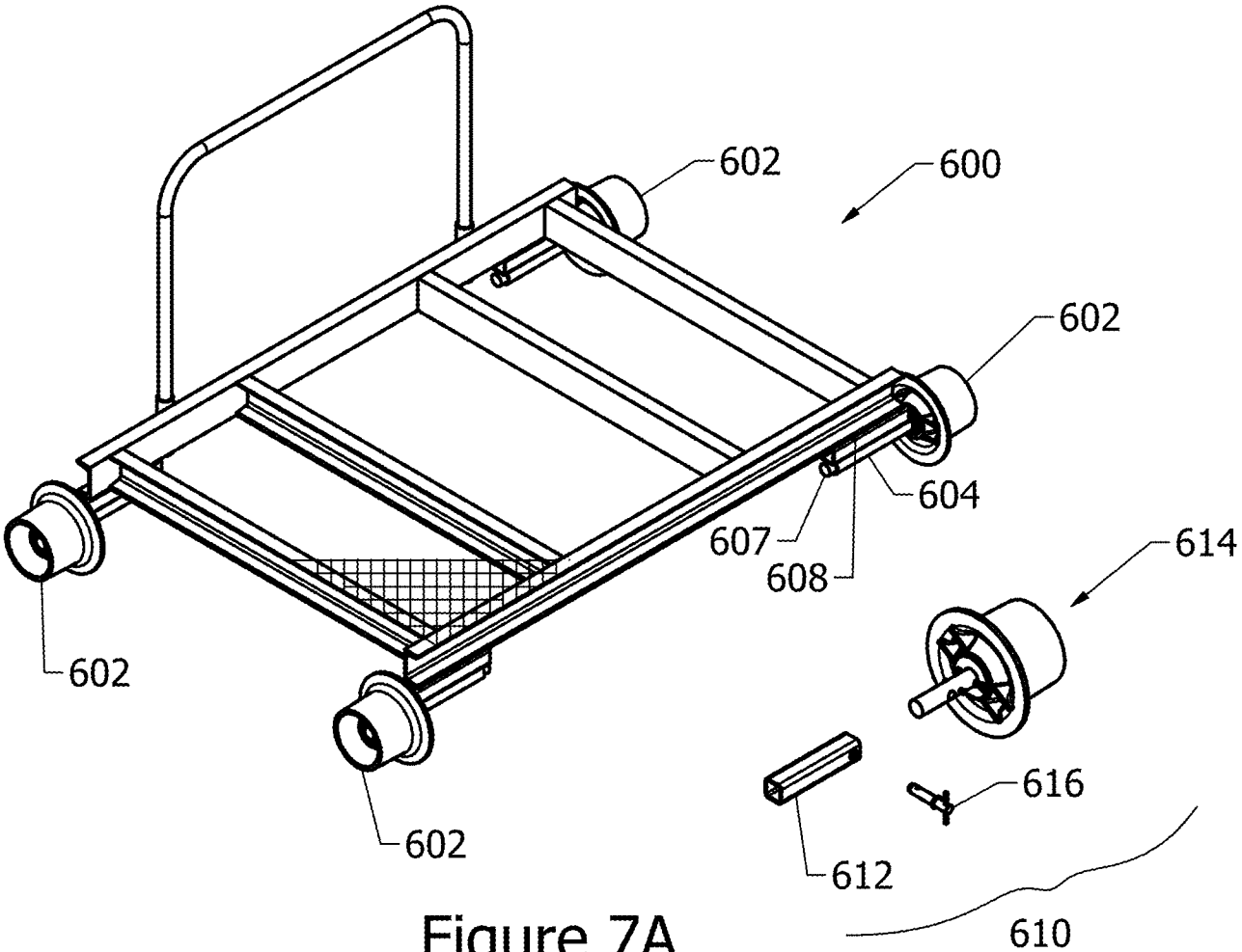
FIG. 7A illustrates a perspective view of the typical existing handcart of FIG. 6, having an assembly for modifying the existing handcart.
Figure 7B:
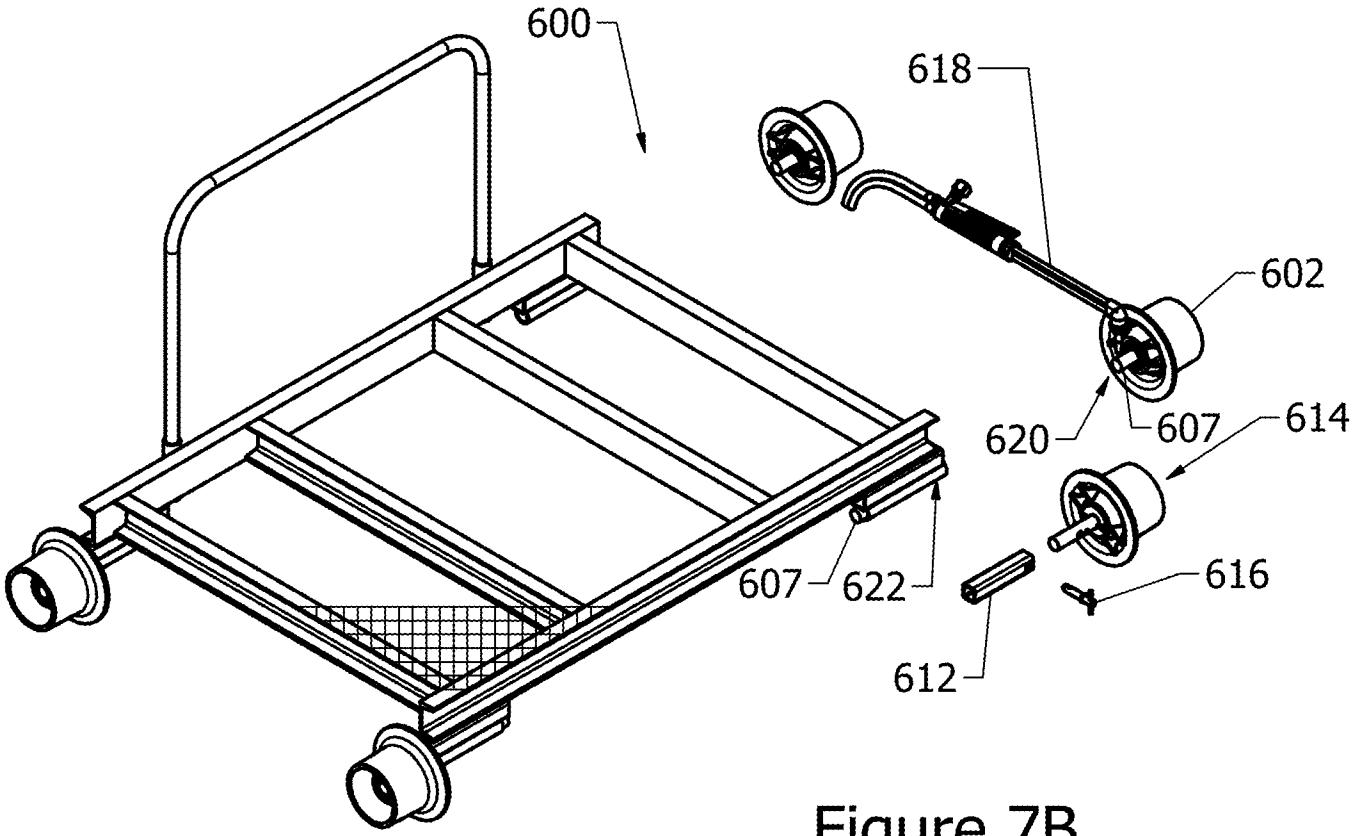
FIG. 7B illustrates a perspective view of the handcart of FIG. 7A having one of its existing wheel assemblies removed.

FIG. 7B illustrates a perspective view of the handcart 600 of FIG. 7A having one of its existing wheel assemblies 602 removed. Referring to FIG. 7B, existing handcart 600 is shown having one of its wheel assemblies 602 being removed with a torch 618. Axle 607 is cut 620, leaving behind a portion 622 of wheel assembly 602. Mounting bracket 612 of detachable wheel assembly 614 is thereby welded or otherwise mechanically and permanently attached to portion 622, which allows for wheel assembly 614 to be attached to existing handcart 600 using pin 616, and to be removable by removing pin 616. That is, mounting bracket 612 is attached to portion 622 of the original wheel assembly 602 that remains attached to handcart 600 after having cut axle 607. And, although FIG. 7B and subsequent figures show mounting bracket 612 mounted to outboard and to the side of portion 622, it is contemplated that mounting bracket 612 may be mounted beneath portion 622 (and thereby beneath axle 607), or inboard of portion 622, as well.

Figure 7C:
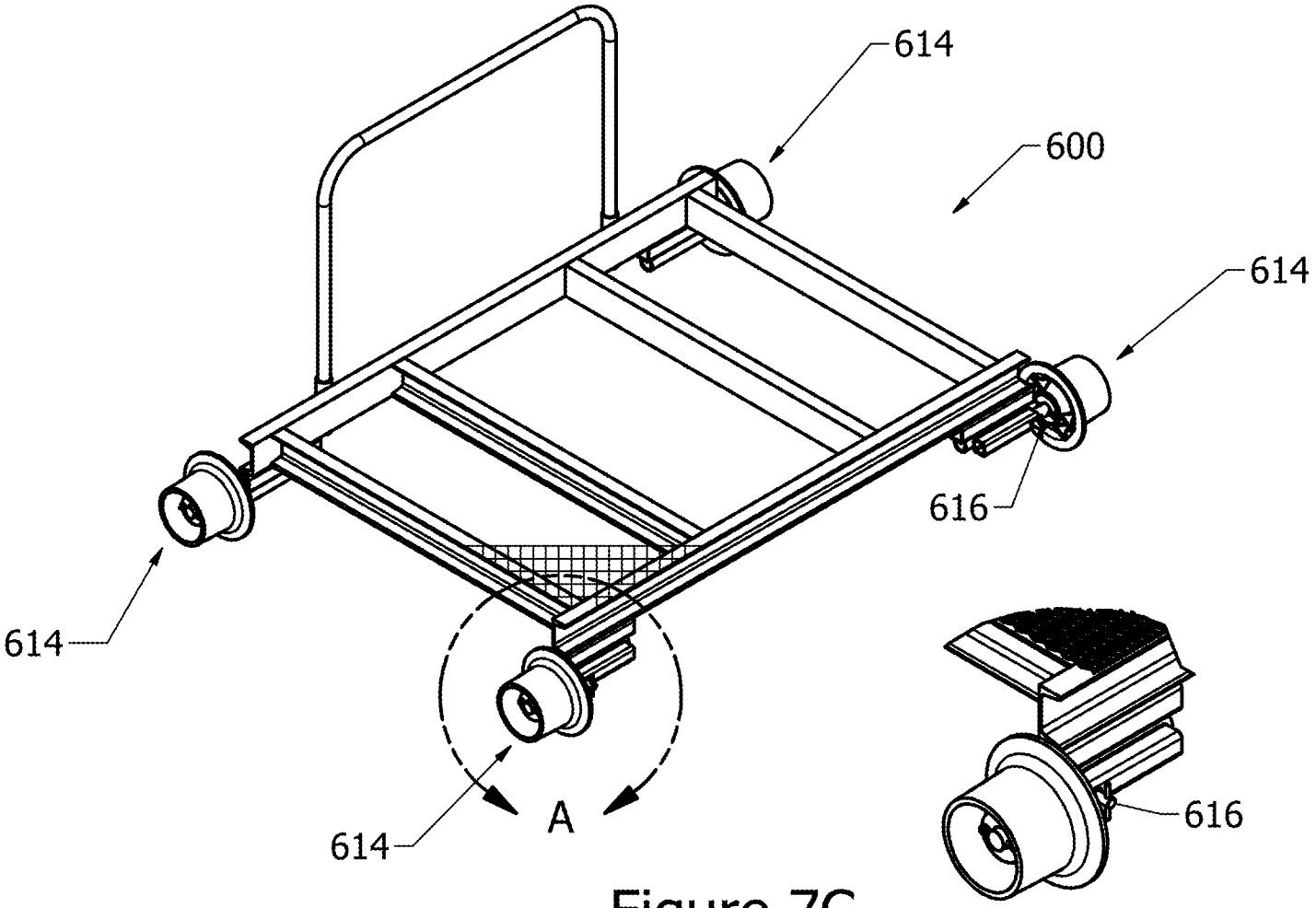
FIG. 7C illustrates a perspective view of the handcart of FIG. 7B having had new wheel assemblies attached thereto according to the disclosure.

FIG. 7C illustrates a perspective view of the handcart 600 of FIG. 7B having had new wheel assemblies attached thereto according to the disclosure. FIG. 7C illustrates existing handcart 600 having detachable wheel assemblies 614 attached thereto. As such, during construction operations or other uses, existing handcart 600 may have its wheel assemblies 614 conveniently removed by simply removing pins 616, such that existing handcart 600 may be transported without having its heavy wheel assemblies 602 thereon.

In an alternate example, referring still to FIGS. 7A-7C, it is contemplated that wheel assembly 614 may be assembled using wheels that are recovered from the existing handcart 600, thereby saving the added cost of having to purchase new wheels. As such, wheel assembly 602 that is cut from existing handcart 600 may thereby be disassembled, and its wheel removed from wheel assembly 602. In such fashion, rather than having to purchase a full assembly 610, only its subcomponents may need to be purchased and the cost of the wheel is saved from additional purchase.

Figure 8A:
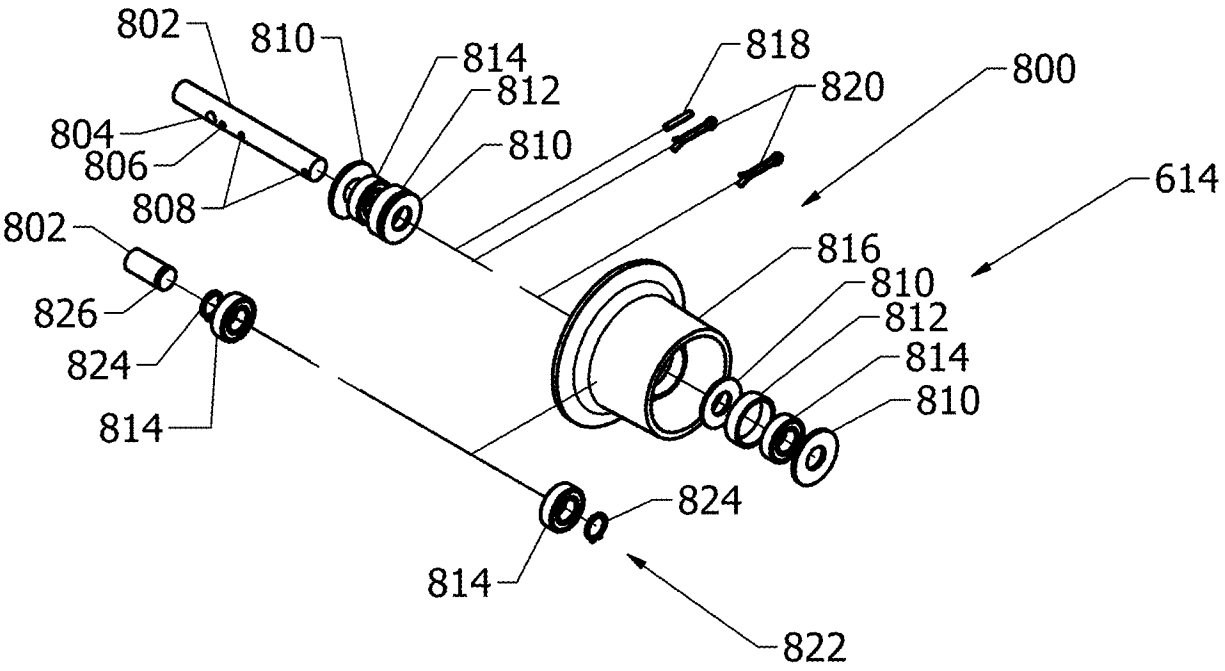
FIG. 8A illustrates an exploded view of a wheel assembly according to the disclosure, in which a wheel previously removed from the handcart is re-furbished according to the disclosure.

For instance, FIG. 8A illustrates an exploded view of a wheel assembly according to the disclosure, in which a wheel previously removed from the handcart is re-furbished according to the disclosure. Exploded view 800 of wheel assembly 614 is illustrated therein. Exploded view 800 includes an axle 802 having a pin hole 804, a stopper hole 806 (in which a stopper may be positioned that corresponds with stopper element 130 described above), and cotter key holes 808. Axial electrically insulating elements 810 and cylindrical electrically insulating elements 812 insulate front and rear bearing assemblies 814 from wheel 816. In one example, wheel 816 may be a wheel that has been recovered from wheel assembly 602 that has been cut from handcart 600, as described above with respect to FIG. 7B. A stopper 818 may be positioned in stopper hole 806, and cotter keys 820 may be positioned within cotter key holes 808.

FIG. 8A also illustrates an alternative locking arrangement 822 that may be used in lieu of cotter keys 820. The alternative arrangement 822 includes bearings 814 having locking rings 824 in grooves 826 of axle 802 that may be used to detachably lock the assembly together (recognizing that insulating elements 810, 812 are included in alternative arrangement 822, although not illustrated).

Figure 8B:
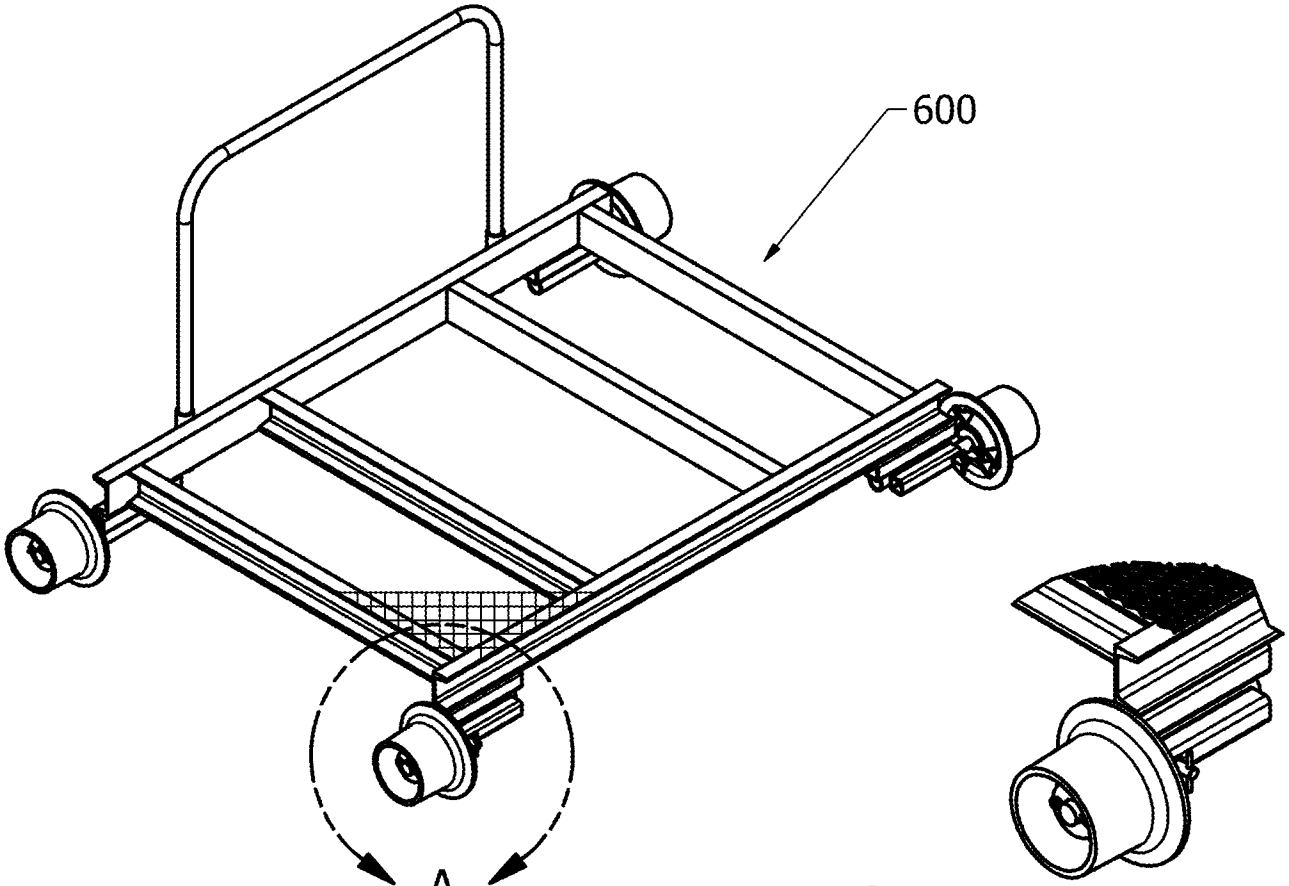
FIG. 8B illustrates a perspective view of the existing handcart of FIG. 7B having had wheel assemblies attached thereto according to the disclosure.

FIG. 8B illustrates a perspective view of the handcart of FIG. 7B having had wheel assemblies attached thereto according to the disclosure. Referring to FIG. 8B, handcart 600 shows disclosed wheel assemblies attached thereto, using replacement wheel assemblies with wheels that are either newly purchased, or recovered from handcart 600.

Figure 9A:
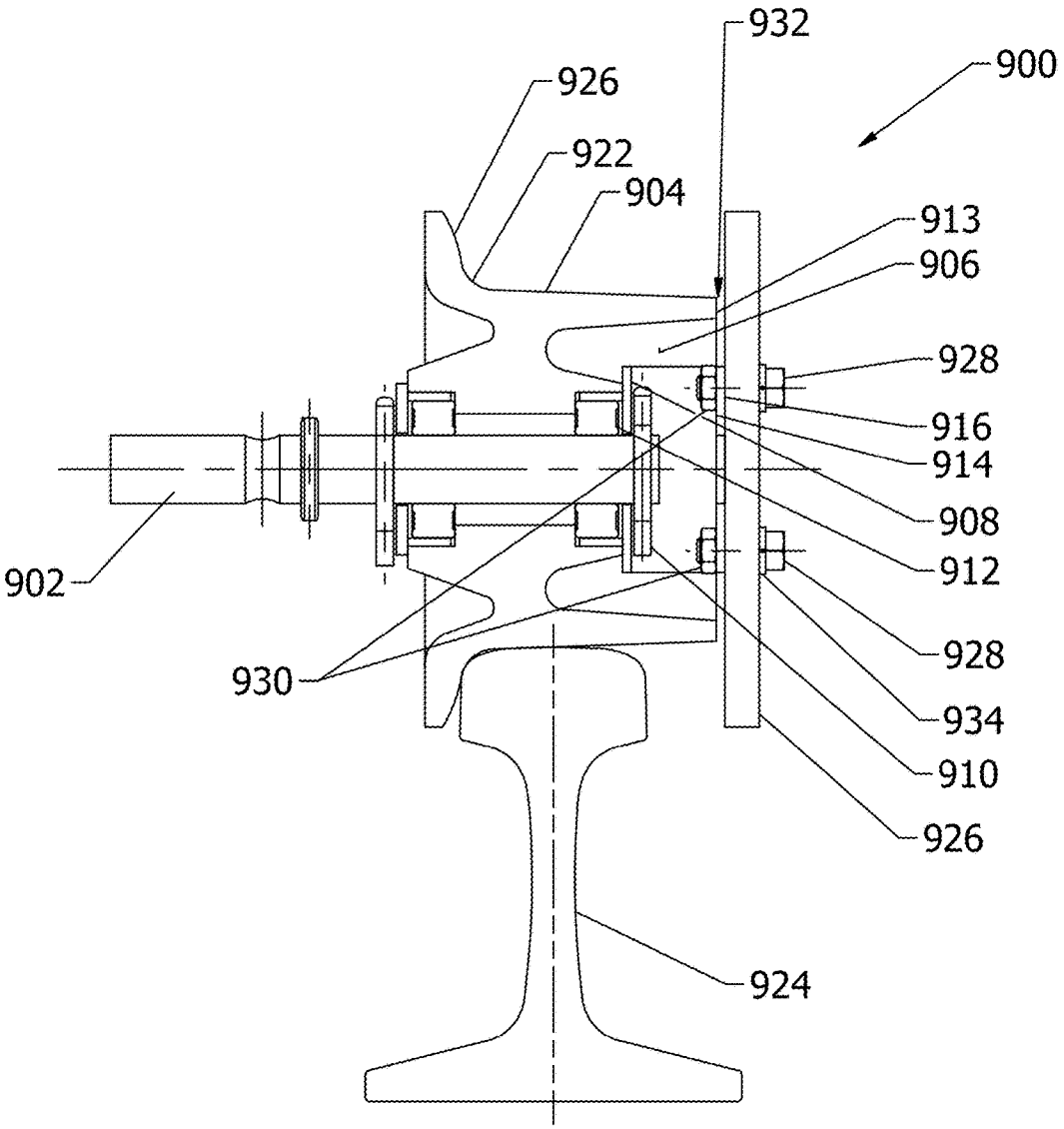
FIG. 9A illustrates an exemplary wheel assembly having a secondary flange attached thereto.
Figure 9B:
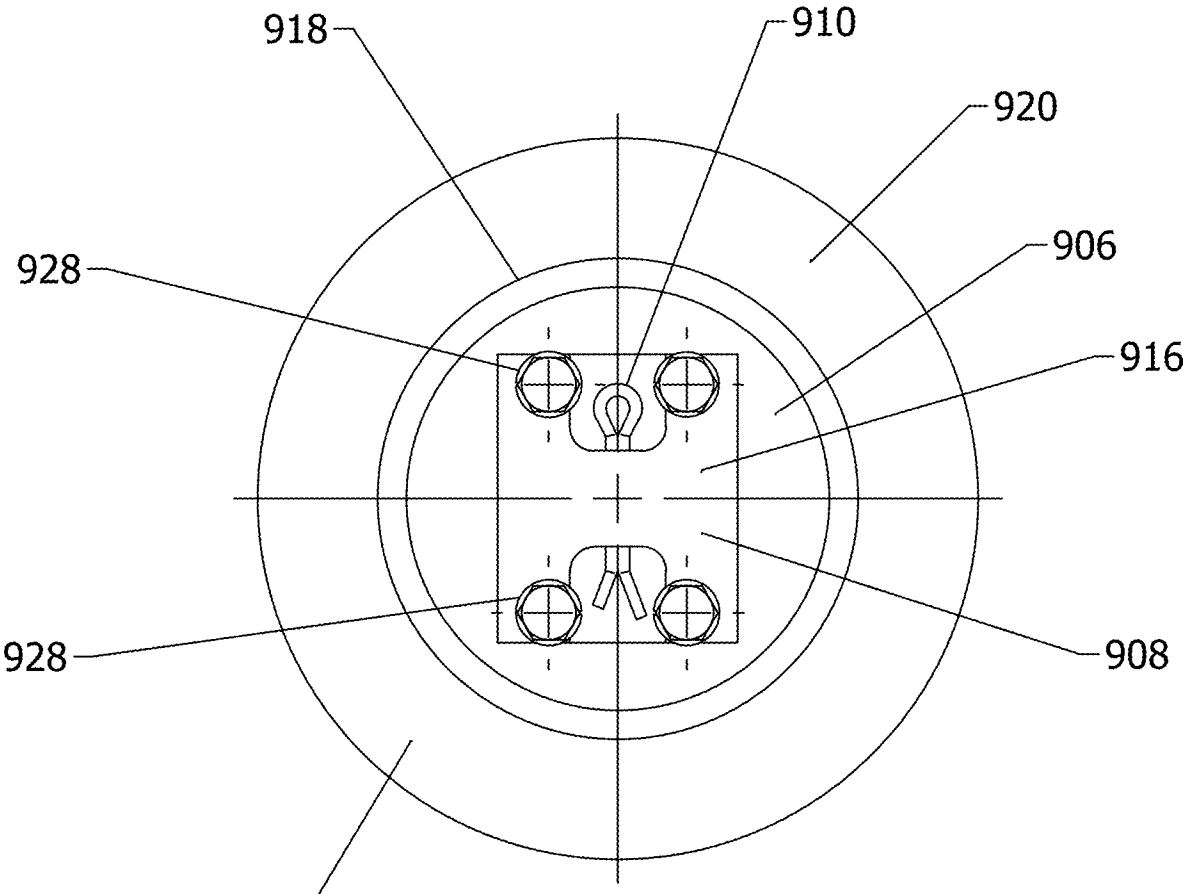
FIG. 9B is an end view of a wheel and mount within an opening of the wheel.
Figure 9C:
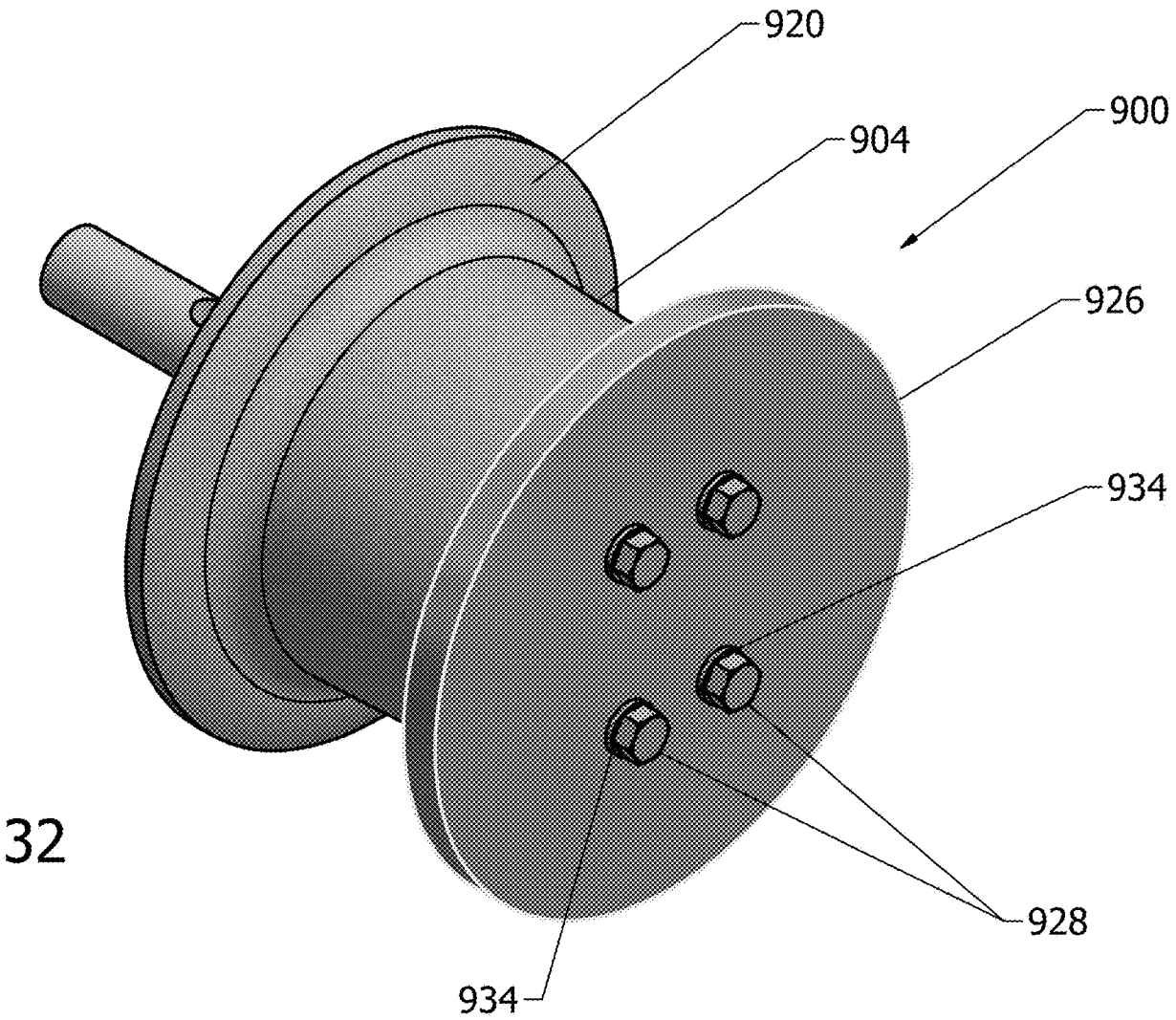
FIG. 9C is a perspective view of the wheel assembly of FIGS. 9A and 9B, having a second flange 926.
Figure 10:
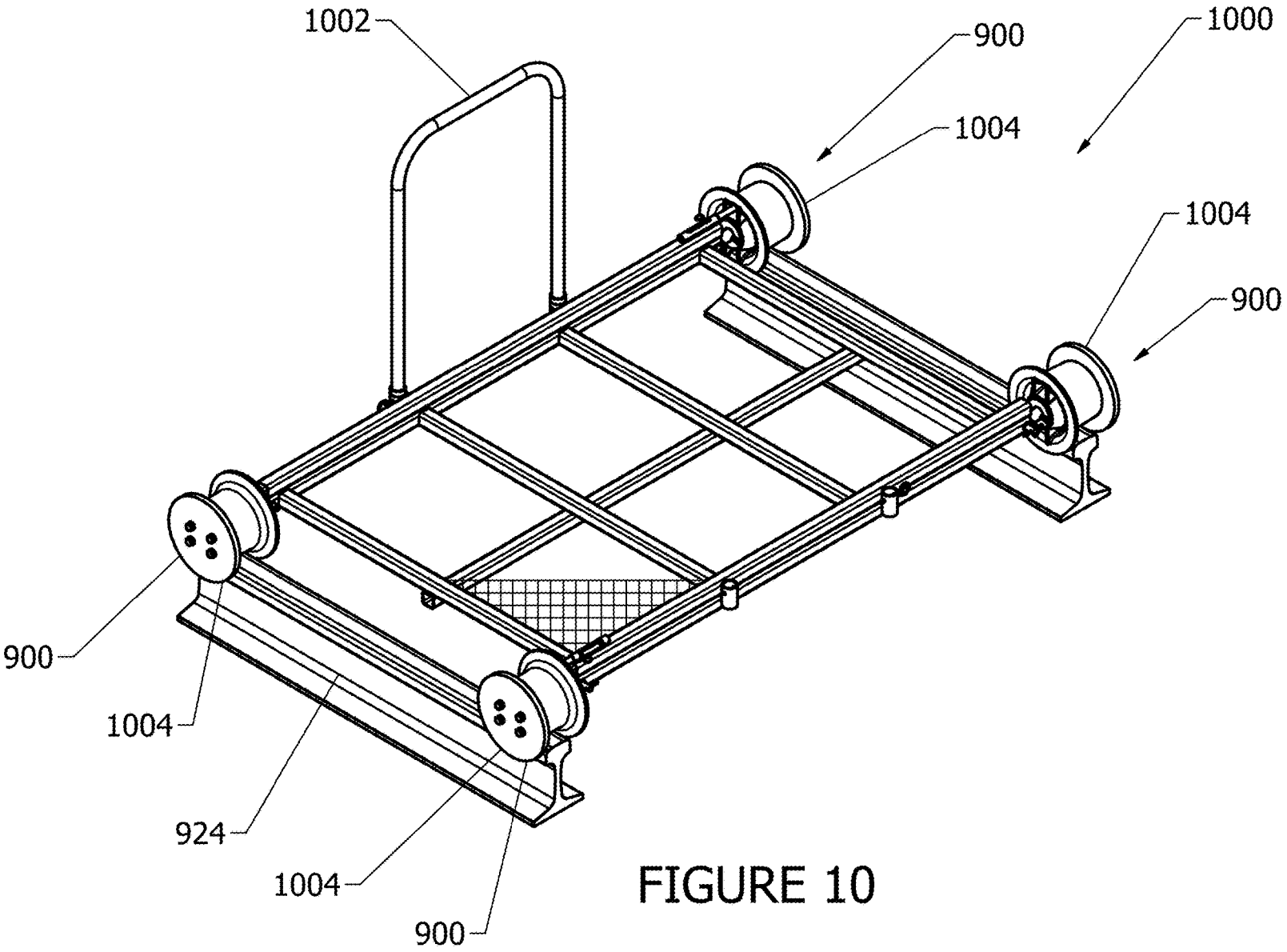
FIG. 10 is a perspective view of an exemplary handcart having wheel assemblies thereon, each having a second flange as illustrated in FIGS. 9A-9C.
Figure 11:
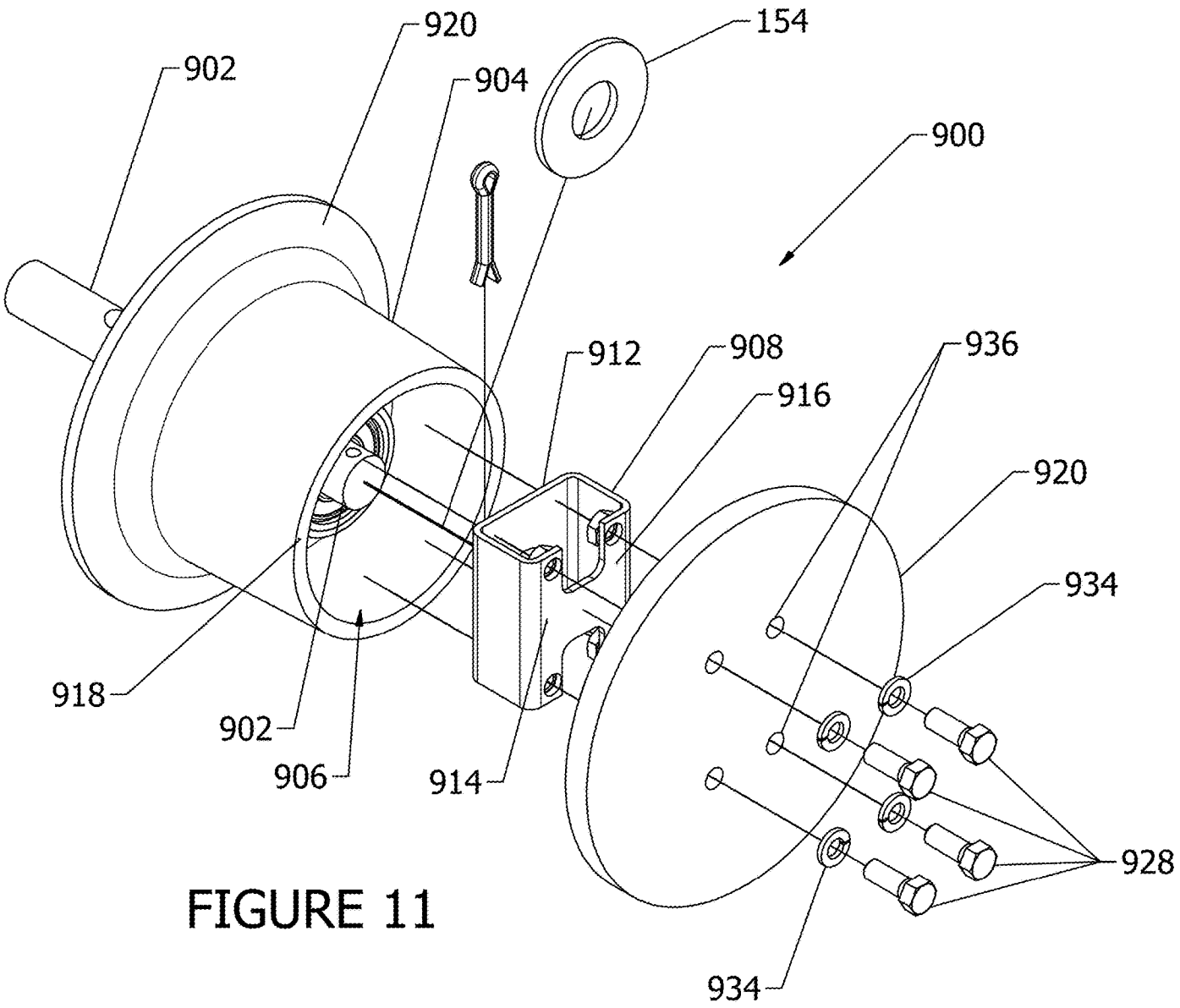
FIG. 11 illustrates an exploded view of the wheel assembly of FIGS. 9A-9C, and as also shown as mounted to the cart in FIG. 10.

FIGS. 9A-9C and 10 illustrate another exemplary wheel assembly according to the disclosure, and FIG. 11 illustrates an expanded view thereof. In general, FIGS. 9A-9C and 10 include a second flange on each wheel of the disclosed cart, to provide further enhanced ability for the cart to avoid any derailment. The disclosed second flange is applicable to all disclosed examples above described in each of FIGS. 1-8B. Each second flange is attached to its axle in a fashion such that the second flanges are stationary with respect to the wheels.

Referring to FIG. 9A, wheel assembly 900 includes axle 902 having all aspects of the assembly disclosed in FIG. 4. Wheel assembly 900 includes a wheel 904 having an opening 906 therein. Opening 906 includes a mount 908 that attaches to an end of axle 902 as shown, and is retained by a cotter key. As described in FIG. 4, cotter key hole 148 is axially positioned such that cotter keys are detachable and axially lock wheel 132 to axle 126. However, in the disclosed example of FIG. 9A, a cotter key 910 is positioned in a hole. Mount 908 includes a base material 912 and support structure 914 that includes surface 916 that extends beyond an end surface 918 of wheel 904. Base material 912 has a thickness approximately that of washer 154 as shown in FIG. 4. Therefore, according to the disclosure, base material 912 is provided in lieu of washer 154 and when base material 912 is included to provide for a second flange, as shown in FIG. 9A. Referring to FIG. 9B, which is an end view of wheel 904 and mount 908 within opening 906, surface 916 is an approximately planar surface of mount 908, and surface 918 is a circular surface of an end of wheel 904. FIGS. 9A and 9B also include a flange 920 which, as seen particularly in FIG. 9A and also in the other figures, is inboard of its respective rail and includes a curved surface 922 that engages with a rail 924. As can be seen in FIG. 1, each wheel assembly 114 engages rails 102, which correspond respectively in FIG. 9A to wheel assembly 900 and rail 924.

Referring again to FIG. 9A, a second flange 926, illustrated generally as a planar disk, is mounted to wheel assembly 900. Bolts 928 pass through corresponding holes in second flange 926, and also into mount 908. Nuts 930 are contained in mount 908 and threaded onto each bolt 928, causing second flange 926 to be attached to mount 908, and thereby to wheel assembly 900.

As indicated, second flange 926 is attached to mount 908, which in turn is mounted to axle 902. Axle 902 is stationary with respect to the cart, so mount 908 and second flange 926 are thereby also stationary with respect to the cart. As such, a gap 932 is included between second flange 926 and surface 918 of wheel 904, such that rubbing does not occur therebetween. Also, it is contemplated that gap 932 is of sufficient dimension to ensure that, under any dynamic loading during use, second flange 926 is not caused to press into or against surface 918. And, gap 932 is also sufficient to ensure that any looseness or "play", in the axial dimension and within the bearings of wheel assembly 900, will not result in rubbing or interference between second flange 926 and surface 918.

Accordingly, referring to FIG. 9C, a perspective view of wheel assembly 900 shows wheel 904 having flange 920, and wheel assembly 900 includes second flange 926 in opposing flange 900. Further, as discussed, bolts 928 are visible, as positioned against second flange 926, which may be screwed and tightened against lock washers 934.

Referring to FIG. 10, an exemplary handcart 1000 is shown, having wheel assemblies 900 thereon, each having a second and stationary flange attached thereto. In operation, as force is applied to a handle 1002, handcart 1000 is caused to move, with each of wheel assemblies 900 being caused to rotate, while each second flange 1004 remains stationary with respect to rails 924.

FIG. 11 illustrates an expanded view of the wheel assembly of FIGS. 9A-9C, and as also shown as mounted to the cart in FIG. 10. Wheel assembly 900 shows axle 902 and includes wheel 904 having opening 906 therein. Mount 908 includes a hole (not visible in FIG. 11) that passes through an end of axle 902 as shown, and is retained by cotter key 910. Mount 908 includes a base material 912 and support structure 914 that includes surface 916 that extends beyond end surface 918 of wheel 904. As discussed, base material 912 is provided in lieu of washer 154 and when base material 912 is included to provide for a second flange. Second flange 926 includes through holes 936, through which bolts 928 pass. Second flange 926, illustrated generally as a planar disk, is mounted to wheel assembly 900. Bolts 928 pass through corresponding holes 936 in second flange 926 and into mount 908. Nuts 930 are contained in mount 908 and threaded onto each bolt 928, causing second flange 926 to be attached to mount 908, and thereby to wheel assembly 900.

Second flange 926 is attached to mount 908, which in turn is mounted to axle 902. Axle 902 is stationary with respect to the cart, so mount 908 and second flange 926 are thereby also stationary with respect to the cart.

Accordingly, and according to the disclosure of FIGS. 9A-9C, 10, and 11, a second flange is provided that provides an additional "capturing" action, in the event that dynamic movement of the handcart could otherwise cause the handcart to derail. The description is best illustrated in reference to FIG. 10. Under conditions of operation a force may be applied to handcart 1000 and particularly to handle 1002. Pushing and/or pulling could result, in some instances, in the propensity for the wheels to pull up from the rails, perhaps only on one side of the handcart, which could lead to derailment of the handcart from the rails. As such, the second and stationary flange may prevent any such derailment by including the second flange that extends in a downward direction, causing the wheels to be captured about each rail, reducing the propensity for the wheels to pull free and derail from each rail.

Accordingly, the disclosed system illustrated in FIGS. 1-5 provides a convenient handcart for reducing the amount of mass that is carried from a truck to a set of railroad tracks, while increasing the carrying or load capacity of the handcart. In one example, the improved structure includes an ability to carry 2000 lb. or more, while reducing the overall mass compared to existing handcarts. In addition, the disclosed apparatus in FIGS. 6-8 includes wheel assemblies that are each separately removable from the handcart so that the wheels can all be separately conveyed, reducing the total amount of weight that must be carried at one time. Still further, the disclosed method includes steps that will reduce the overall cost of obtaining the disclosed benefits. That is, instead of purchasing a fully assembled handcart with removable wheel assemblies, the disclosed method allows for wheel assemblies to be destructively removed form an existing handcart (in which the wheel assemblies are hard-mounted to the handcart), while allowing the wheels to be re-used after having been removed from the existing handcart. Also, the disclosed handcart includes troughs or depressions that prevent tools or other materials from rolling off of the handcart during movement of the handcart to a worksite and while moving on a set of railroad tracks. And, the disclosed apparatus in FIGS. 9A-11 provide an additional or second flange, outboard of each rail, that reduce the propensity for derailment of the handcart.

It is to be understood that the above description is intended to be illustrative and not restrictive. Many applications other than the examples provided would be upon reading the above description. The scope of the disclosure should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the disclosure is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A handcart for manually conveying objects on a pair of railroad rails, the handcart comprising:

a first structure having a first end and a second end, the first end having a first opening therein;

a second structure attached to a first support bar such that a frame is formed between the first and second structures by one or more crossbeams;

a first wheel assembly having a first wheel and a first axle extending therefrom, the first axle detachably locked via the first axle positioned in the first opening; and a platform positioned between the first structure and the first support bar and on a bottom of the one or more crossbeams, forming a depression area between the one or more crossbeams and the first structure.

2. The handcart of claim 1, wherein the first axle includes a first through hole and the first structure includes a second through hole, such that when the first axle is positioned within the first opening, the first through hole and the second through hole align with one another such that a first pin passes through both the first and second through holes, detachably locking the first axle to the first structure.

3. The handcart of claim 2, further comprising a second wheel assembly having a second wheel and a second axle extending therefrom that is detachably locked to the second end of the first structure, such that the first and second wheels are spaced apart from one another to match a gage of the pair of railroad rails.

4. The handcart of claim 3, wherein:

the second end of the first structure includes a second opening therein;

the second axle is positioned within the second opening; and the second axle includes a third through hole and the first structure includes a fourth through hole that align with one another such that a second pin passes through both the third and fourth through holes, detachably locking the second axle to the first structure.

5. The handcart of claim 1, wherein the first wheel assembly includes an electrically insulating material that electrically insulates the first wheel from the first axle.

6. The handcart of claim 1, further comprising a first support bar attached to a top of the first structure, and a second support bar attached to a top of the second structure.

7. The handcart of claim 1, wherein the first wheel includes a first flange that is inboard of the railroad rails when the handcart is positioned thereon, and a second flange that is outboard of the railroad rails when the handcart is positioned thereon, the second flange being removably attached to the first wheel assembly.

8. The handcart of claim 7, further comprising a mount structure, wherein the second flange is attached to an axle of the handcart via the mount structure.

9. A method of fabricating a handcart for manually conveying objects on a pair of railroad rails, the method comprising:

providing a first structure having a first end and a second end, the first end having a first opening therein;

attaching a second structure to a first support bar such that a frame is formed between the first and second structures by one or more crossbeams;

providing a first wheel assembly having a first wheel and a first axle extending therefrom;

detachably locking the first axle in the first opening;

positioning a platform between the first structure and the first support bar and on a bottom of the one or more crossbeams; and forming a depression area between the one or more crossbeams and the first structure.

10. The method of claim 9, wherein the first axle includes a first through hole and the first structure includes a second through hole, the method further comprising:

positioning the first axle within the first opening to align the first through hole and the second through hole with one another; and passing a first pin through both the first and second through holes, detachably locking the first axle to the first structure.

11. The method of claim 9, further comprising:

providing a second wheel assembly having a second wheel and a second axle extending therefrom; and detachably locking a second axle to the second end of the first structure, such that the first and second wheels are spaced apart from one another to match a gage of the pair of railroad rails.

12. The method of claim 11, wherein the second end of the first structure includes a second opening therein; and the second axle includes a third through hole and the first structure includes a fourth through hole that align with one another such that a second pin passes through both the third and fourth through holes;

the method further comprising:

positioning the second axle within the second opening; and detachably locking the second axle to the first structure.

13. The method of claim 9, further comprising inserting an electrically insulating material between the first wheel and the first axle to electrically insulate the first wheel from the first axle.

14. The method of claim 9, further comprising attaching a first support bar to a top of the first structure, and attaching a second support bar to a top of the second structure.

15. A method of modifying a handcart for conveying objects on a pair of railroad rails, the method comprising:

providing a handcart that includes at least one wheel having a welded axle that is welded to a frame of the handcart;

cutting the welded axle to remove the at least one wheel from the handcart; and welding a wheel assembly to the handcart at a location proximate where the welded axle was cut;

wherein the wheel assembly includes a structure having an opening therein, the wheel assembly having a first wheel having a first axle extending therefrom and detachably locked to the structure via the first axle within the opening; and wherein the handcart includes a platform positioned between a first structure and a first support bar and on a bottom of the one or more crossbeams, forming a depression area between the one or more crossbeams and the first structure.

16. The method of claim 15, wherein the first axle includes a first through hole and the structure includes a second through hole, such that when the first axle is positioned within the opening, the first through hole and the second through hole align with one another such that a pin passes through both the first and second through holes, detachably locking the first axle to the structure.

17. The method of claim 15, further comprising inserting an electrically insulating material between the first wheel and the first axle to electrically insulate the first wheel from the first axle.

18. The method of claim 15, wherein cutting the welded axle comprises cutting the axle with a torch.

* * * * *